US007917977B1

(12) United States Patent
Remis

(10) Patent No.: US 7,917,977 B1
(45) Date of Patent: Apr. 5, 2011

(54) BOX SPRING SAFE

(76) Inventor: Steven Remis, Denver, CO (US)

( * ) Notice: Subject to any disclaimer, the term of this patent is extended or adjusted under 35 U.S.C. 154(b) by 0 days.

(21) Appl. No.: 12/012,779

(22) Filed: Feb. 5, 2008

(51) Int. Cl.
*A47C 19/22* (2006.01)

(52) U.S. Cl. ..... 5/308; 5/931

(58) Field of Classification Search ..... 5/308, 58, 5/694, 931; 109/51; 220/655
See application file for complete search history.

(56) References Cited

U.S. PATENT DOCUMENTS 1,291,794 A * 1/1919 Droste ..... 5/308
1,357,951 A * 11/1920 Camenisch ..... 5/308
1,859,912 A * 5/1932 Brooker ..... 5/308
2,567,630 A * 9/1951 Whittier et al. ..... 5/308
2,895,145 A * 7/1959 Soifer ..... 5/308
4,129,909 A * 12/1978 Riehl ..... 5/503.1
5,070,556 A * 12/1991 Gloger ..... 5/308
5,361,434 A * 11/1994 Hagemeister et al. ..... 5/247
5,687,435 A * 11/1997 Dufresne ..... 5/10.1
5,704,595 A * 1/1998 Kitchen et al. ..... 267/103
6,082,272 A * 7/2000 Adrain ..... 109/51
6,292,960 B1 * 9/2001 Bowling ..... 5/308
6,578,213 B2 * 6/2003 Dabney ..... 5/247
6,615,425 B1 * 9/2003 Candell ..... 5/400
6,684,432 B2 * 2/2004 Owens, Jr. ..... 5/694

* cited by examiner

*Primary Examiner* — Robert G Santos
*Assistant Examiner* — Nicholas Polito
(74) *Attorney, Agent, or Firm* — Ramon L. Pizarro; Edwin W. Crabtree

(57) ABSTRACT

A system and method for providing a storage area within a box spring is disclosed. The system uses a storage box having a storage compartment and a locking door that provides access to the storage compartment. Attached to the storage box is a base plate that is attached to the storage compartment, the base plate includes an engagement hook. The box spring includes a stringer, and is used to support a mattress. The engagement hook of the base plate of the storage box engages the stringer of the box spring while the storage box is in use, so that the storage box is retained within the box spring.

3 Claims, 5 Drawing Sheets

BOX SPRING SAFE

BACKGROUND OF THE INVENTION

Field of the Invention

This invention generally relates to a device or system for concealing or storing items within the spring box of a bed. More particularly, but not by way of limitation, to a lockable storage safe or box that nests within the spring elements of a box spring foundation of a bed.

SUMMARY

It has been discovered that the problems left unanswered by known art can be solved by providing a storage safe or locking box that can be incorporated into a box spring used to support a mattress, an example of the disclosed invention includes:

a storage compartment;

a base plate having an engagement hook; and a locking door.

According to a highly preferred embodiment of the invention the storage compartment is sized to fit between the nesting wire assemblies and the wooden frames used in box spring assemblies such as the assemblies disclosed in U.S. Pat. Nos. 5,361,434 to Hagemeister et al., 5,704,595 to Kitchen et al., and 6,578,213 to Dabney, all of which are incorporated herein in their entirety by reference.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
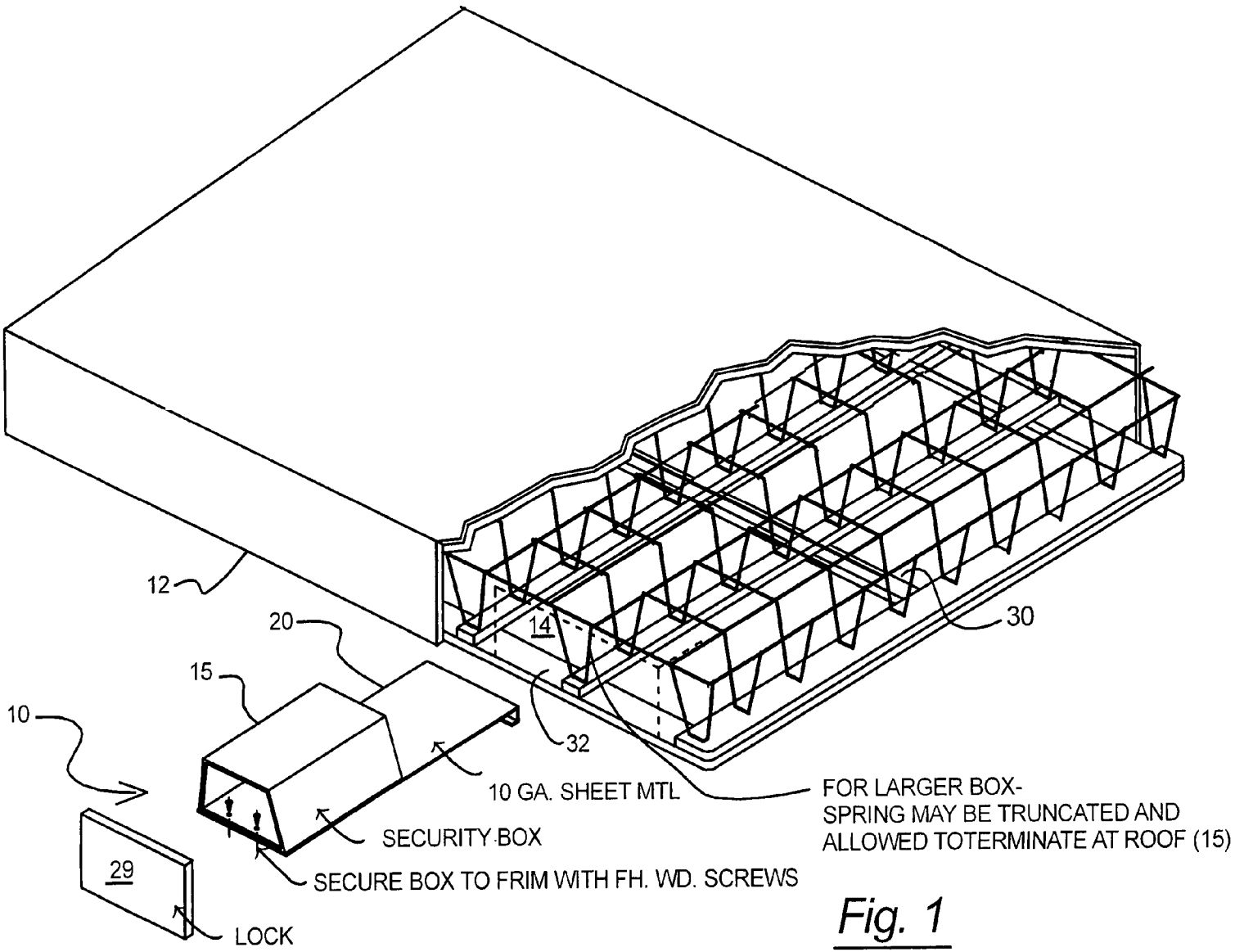
FIG. 1 is a perspective view of an embodiment of the invention prior to installation into a box spring assembly.
Figure 2:
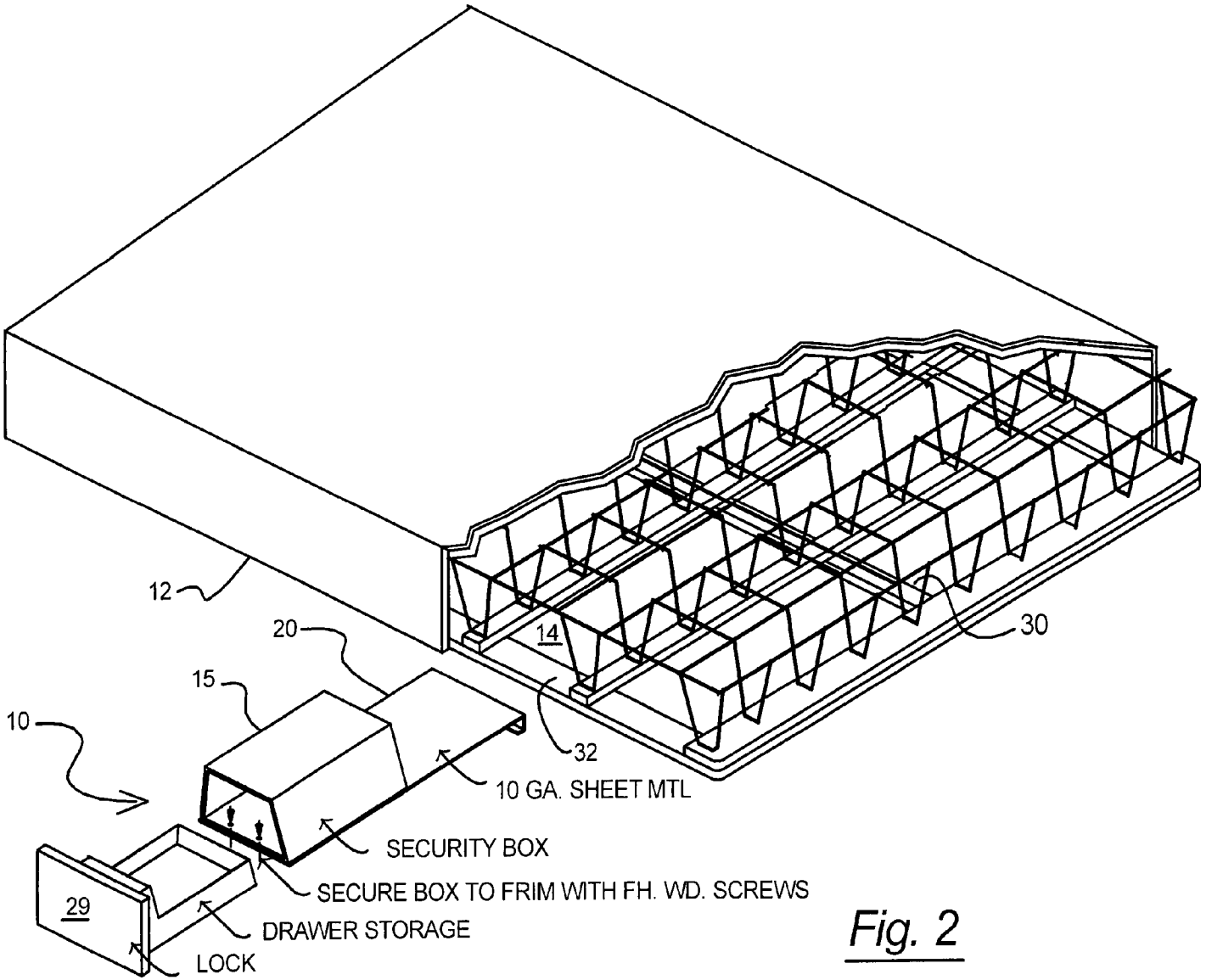
FIG. 2 is a perspective view of another embodiment of the invention prior to installation into a box spring assembly. The example uses a drawer that is integral with the lockable cover used to close the storage compartment.

Turning now to FIG. 1 where an example of the disclosed box spring safe 10 is illustrated prior to insertion into the box spring assembly 12. As mentioned above, the disclosed box spring safe 10 takes advantage of the space 14 created in the structure of box spring assemblies such as those disclosed in U.S. Pat. Nos. 5,361,434 to Hagemeister et al., 5,704,595 to Kitchen et al., and 6,578,213 to Dabney. It is also contemplated that in the event that a larger safe is needed, for example a safe that is designed to hold a laptop computer, some of the spring members may be cut such that they terminate against the roof 15 of the box, such that the load carried by the spring will be transferred to the roof of the safe 10, allowing it to then be transferred to the rest of the structure of the box spring assembly. In the event that shortening of the spring increases the stiffness of the location where the springs have been shortened, it is contemplated that short springs with less stiffness may be used at these locations.

Figure 3:
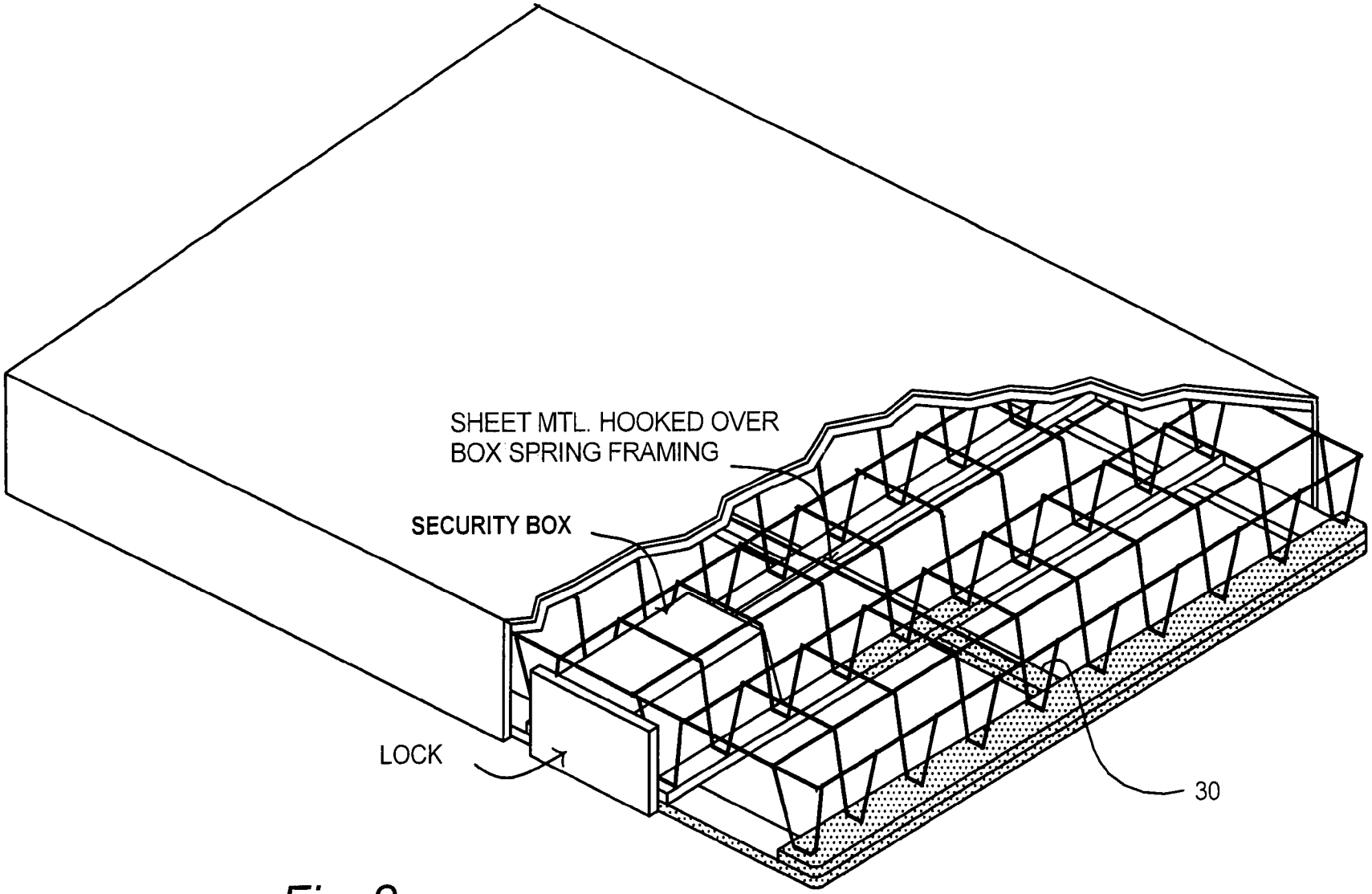
FIG. 3 illustrates an installed example, and also illustrates the cooperation of the engagement hook on base plate and a stringer in the box spring assembly.
Figure 4:
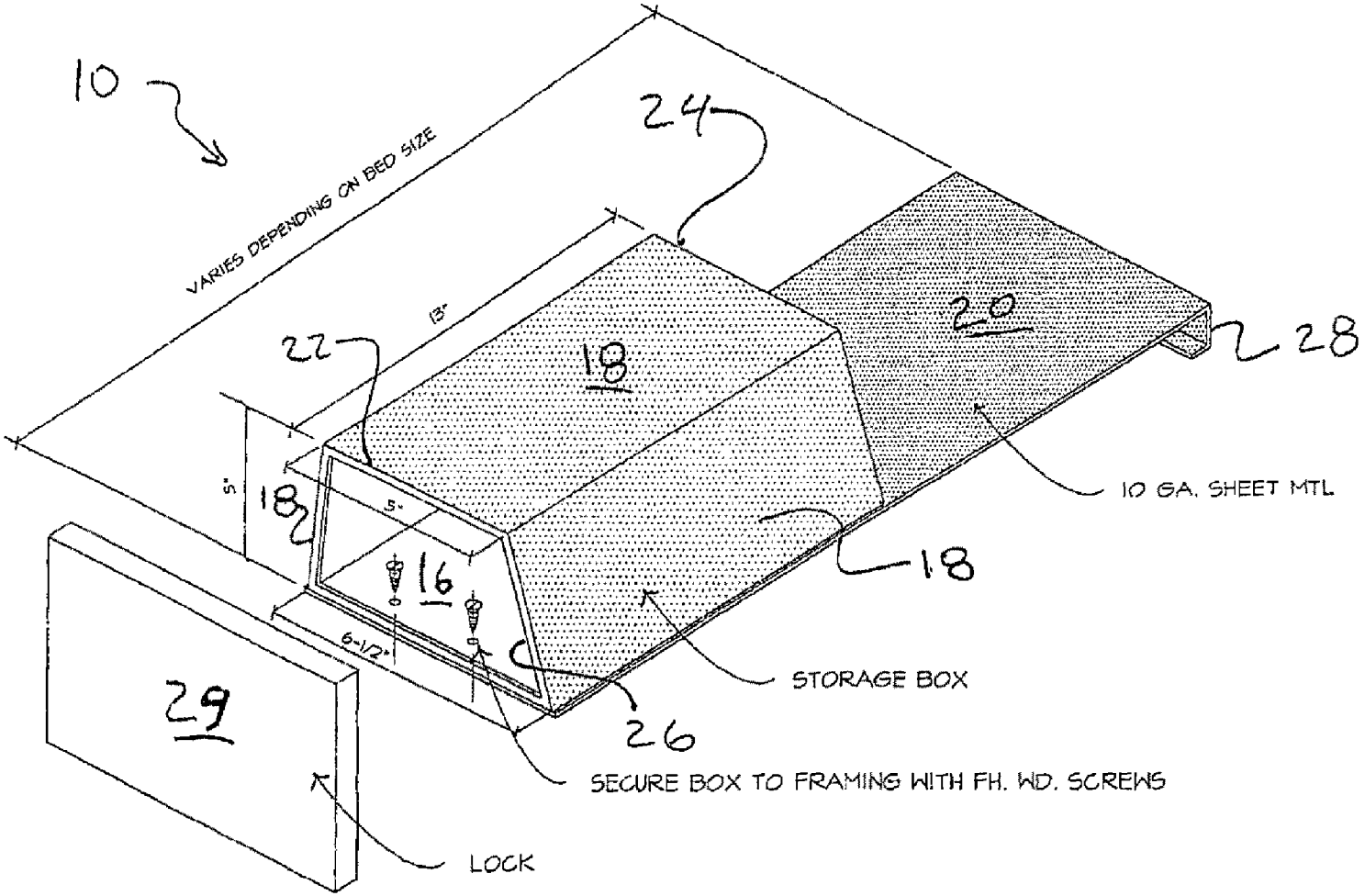
FIG. 4 is a close-up view of an example that uses a lockable cover as the locking door used to close the storage compartment.

Referring now to FIGS. 3 and 4 it will be understood that the box spring safe 10 will include a storage compartment 16 that will include at least three sides 18. The storage compartment 16 will also include a front portion 22 and a rear portion 24. The front portion 22 will include an inlet 26 which will be closed off by a locking door 29. Additionally, the storage compartment 16 will be attached to a base plate 20 that extends away from the storage compartment 16, the base plate 20 extending in a direction from the front portion 22 to the rear portion 24. The example of the base plate 20 shown in the enclosed drawings has an engagement hook 28 that is made by simply bending the base plate into a hook shape. However, it is contemplated that the hook portion may be a separate hook that is fastened to the base plate 20.

As illustrated in FIG. 3, the hook 28 engages a stringer 30 in the box spring assembly 12. FIG. 4 illustrates that the front portion 22 of the storage compartment 16 will be adapted for fastening the front portion 22 to the structure 32 of the box spring assembly 12.

Figure 5:
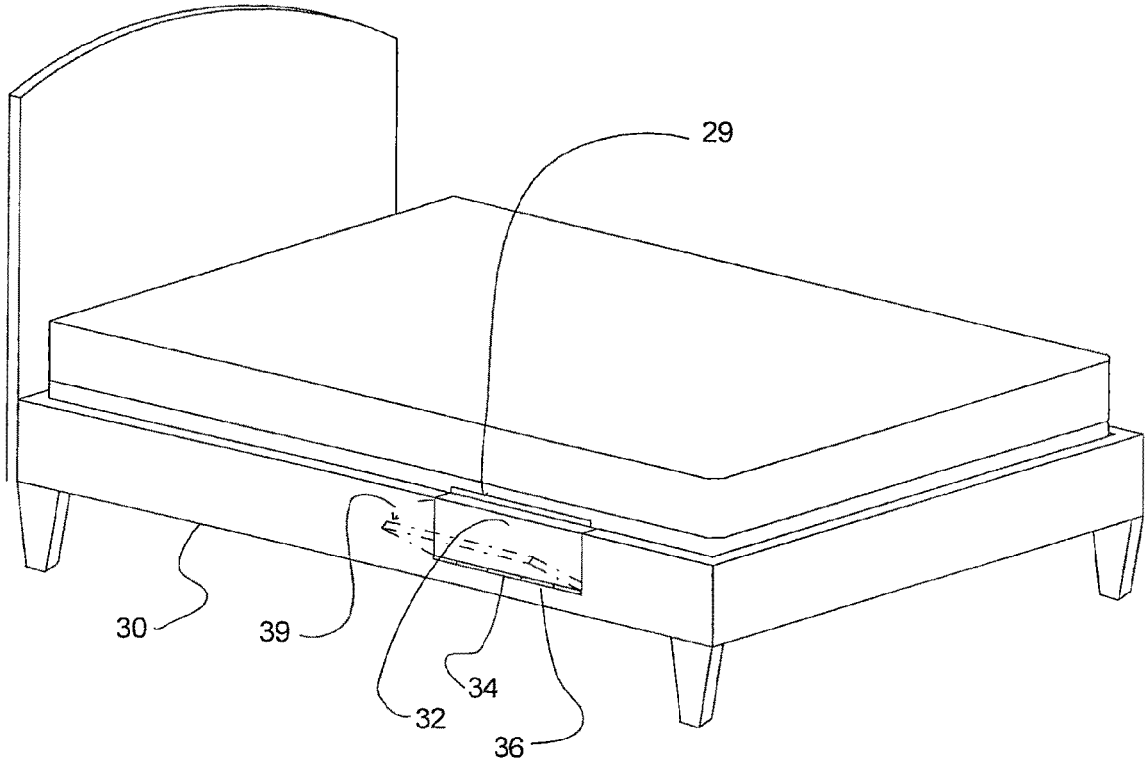
FIG. 5 illustrates the use of a bed frame that includes a swing door with a hinge that provides access to the locking door of the storage compartment.

FIG. 5 illustrates the box spring safe 10 in use with a bed frame 30 that includes a swing door 32 with a hinge 34 that provides access to the locking door 29 of the storage compartment 16. The swing door 32 will preferably be mounted through a spring-loaded piano hinge 36 serving as the hinge 34. The spring-loaded piano hinge 36 will allow the swing door 32 to move in direction of the arrow 39 to provide access to the locking door 29, and then the spring-loaded action will bring the swing door 32 back to the upright position when the user has finished accessing the box spring safe 10.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A storage box for use within a box spring having at least one stringer, the box spring used to support a mattress, the storage box comprising: a storage compartment; a planar base plate that is attached to the storage compartment, the base plate having an engagement hook that is integral with the base plate and extends from the base plate and away from the storage compartment and over the base plate such that the base plate extends between the engagement hook and the storage compartment in a planar fashion, separating the storage compartment from the engagement hook such that the base plate extends, in a planar fashion, between the engagement hook and the storage compartment, the engagement hook being adapted for accepting the at least one stringer to retain the storage box from the at least one stringer of the box spring, the base plate being fixedly attached to the storage compartment, the base plate extending beyond the storage compartment.

2. A storage system comprising: a storage box having a storage compartment; a box spring used to support a mattress, the box spring having structure and internal stringers; a planar base plate that is fixedly attached to the storage compartment, the base plate having an engagement hook that is of integral, one-piece construction with the base plate, the engagement hook extending from the base plate and away from the storage compartment and over the base plate, such that the base plate extends between the engagement hook and the storage compartment in a planar fashion, separating the storage compartment from the engagement hook such that the base plate extends, in a planar fashion, between the engagement hook and the storage compartment, the hook being adapted for accepting at least one of said stringers to retain the storage box from one of the internal stringers, the base plate extending beyond the storage compartment, so that the storage box is supported from the base plate which extends from the storage compartment adjacent to at least one of said stringers; and a locking door that provides access to the storage compartment, so that the engagement hook of the base plate secures the storage box to the box spring while the storage box is in use.

3. A method for providing a storage area, the method comprising: providing a storage box having a storage compartment and a locking door that provides access to the storage compartment; providing a box spring used to support a mattress, the box spring having structure and having a stringer within the box spring; providing a planar base plate that is fixedly attached to the storage compartment, the base plate having an engagement hook that is integral with the base plate and extends from the base plate and away from the storage compartment and over the base plate, the base plate extending between the engagement hook and the storage compartment in a planar fashion, separating the storage compartment from the engagement hook such that the base plate extends, in a planar fashion, between the engagement hook and the storage compartment, the hook being adapted for accepting the stringer to retain the storage box from the stringer of the box spring, so that the storage box can be supported from the base plate which extends from the storage compartment adjacent to the stringer; inserting the base plate into the box spring and over the stringer, and attaching the engagement hook of the base plate of the storage box to the stringer of the box spring, and supporting the storage box from the base plate while supporting base plate from the stringer, so that the storage box is retained within the box spring.

* * * * *